United States Patent [19]

Schütz

[11] 4,157,609

[45] Jun. 12, 1979

[54] PROCESS FOR THE MANUFACTURE OF A PALLET-MOUNTED CONTAINER

[76] Inventor: Udo Schütz, Rückersteg 4, D-5418 Selters, Fed. Rep. of Germany

[21] Appl. No.: 827,312

[22] Filed: Aug. 24, 1977

[30] Foreign Application Priority Data

Aug. 25, 1976 [DE] Fed. Rep. of Germany ..... 2638238

[51] Int. Cl.[2] ..... B23P 19/00

[52] U.S. Cl. ..... 29/428; 217/43 A; 220/1.5; 220/462; 228/151; 228/155

[58] Field of Search ..... 29/428, 469; 217/43 A; 220/462, 1.5, 419; 228/150, 144, 155, 151

[56] References Cited

U.S. PATENT DOCUMENTS

| | | | |
|---|---|---|---|
| 756,832 | 4/1904 | Cleveland | 228/150 |
| 3,162,331 | 12/1964 | Hutchins et al. | 220/1.5 X |
| 3,220,612 | 11/1965 | Thomson | 220/1.5 X |
| 3,337,086 | 8/1967 | Jenks | 220/462 X |
| 3,812,995 | 5/1974 | Lewis | 220/1.5 |

*Primary Examiner*—Charlie T. Moon
*Attorney, Agent, or Firm*—Young & Thompson

[57] ABSTRACT

A pallet-mounted container for liquids comprises a synthetic resin container in a metal shell that supports the container. The metal shell is a sheet metal jacket with a welded-on lid and bottom and is attached to a supporting wooden pallet. The shell is formed, starting from a tube with a longitudinal welded seam. The tube is then deformed by fluid pressure by a fluid pressure press to a rectangular cross section with rounded corners, having two long sides and two short sides. The welded seam is on one of the short sides; and the long sides are stretched beyond their elastic limit between the expansion jaws of the press. A vertically spaced apart series of peepholes is provided along one corner, for visually detecting liquid level through the translucent material of the liner.

2 Claims, 3 Drawing Figures

Fig. 1
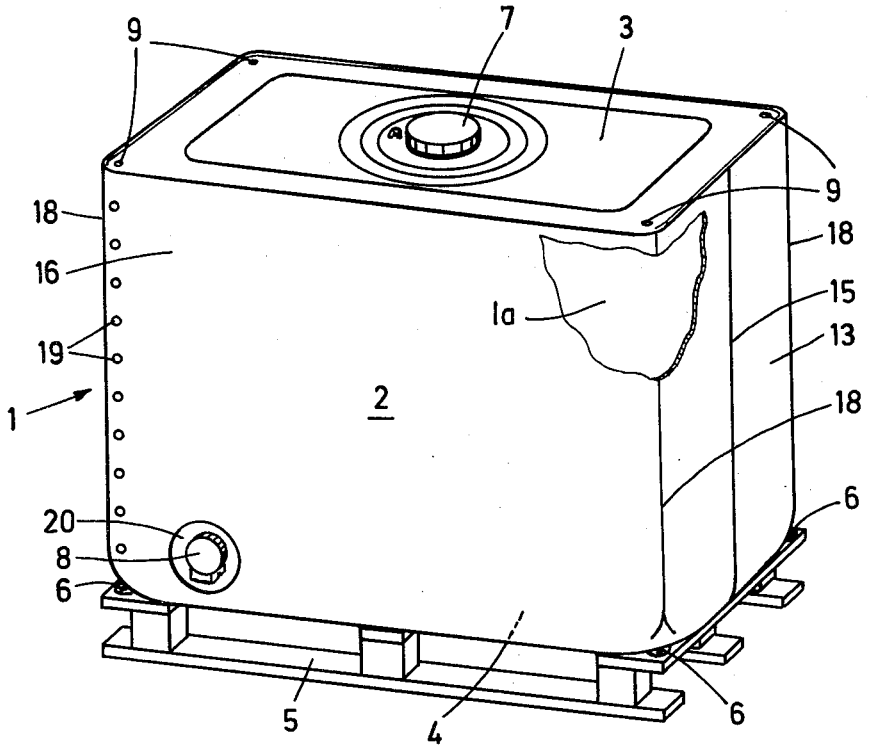
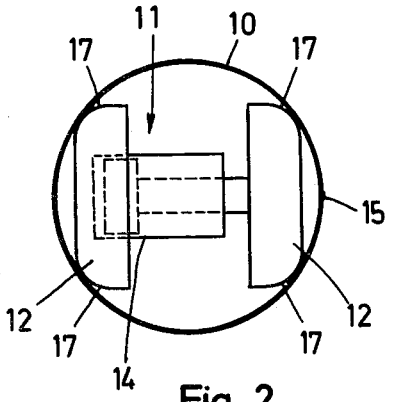
Fig. 2
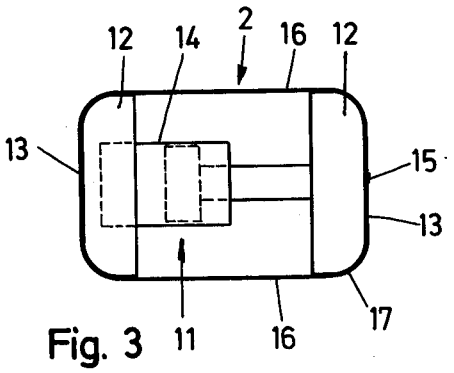
Fig. 3

PROCESS FOR THE MANUFACTURE OF A PALLET-MOUNTED CONTAINER

The present invention is an improvement on that disclosed in my copending application Ser. No. 701,742, filed June 30, 1976.

In the earlier application there is disclosed a pallet-mounted container of a synthetic resin for liquids, having one sealable filling opening and one discharge opening, the container being surrounded by a supporting frame so that one container can be stacked on top of the other, wherein the supporting frame consists of a shell closely contacting the plastic container and provided with a sheet-metal jacket with a welded-on lid and bottom, this shell being attached by means of claw plates to a customary flat pallet, and wherein cutouts in the shell make the filling opening and discharge opening of the container accessible.

It is an object of the present invention to improve the pallet-mounted container according to my previous application, with respect to its ruggedness, by means of a manufacturing method which affords savings in money and material, and to fashion this container so that the level of liquid in the container can be visually monitored.

This object is attained in accordance with the present invention in that, at one of the four rounded vertical edges of the shell, peepholes are arranged, disposed at mutual spacings one above the other, in the sheet-metal jacket to make it possible to see and hence control the level of the liquid in the container, and in that the sheet-metal jacket of the shell consists of steel sheet which is stretched especially along the major sides of the sheet-metal jacket.

The process of this invention for the manufacture of such a pallet-mounted container, especially the shell thereof, is characterized in that a rectangular cut-to-size blank of the steel sheet is bent in the manner of a tube and is then welded along its longitudinal side edges. The thus-formed sheet-metal tube is pulled over a rack press wherein the shape of the expansion jaws corresponds to the shape of the plastic container along the narrow sides. By moving the expansion jaws of the rack press apart, the main sides of the sheet-metal jacket are stretched beyond the elastic limit of the material and thus are stress-hardened. Subsequently, the peepholes are punched in.

During this procedure, the longitudinally welded sheet-metal tube is advantageously placed on the rack press so that the longitudinal weld seam is on one of the two narrow sides of the sheet-metal jacket.

The invention will be described with reference to the drawing, showing an embodiment of the invention.

In the drawing:

FIG. 1 is a perspective view of a pallet container according to this invention; while FIGS. 2 and 3 show two phases of the process for the production of the sheet-metal jacket of the shell of the pallet container in a schematic view.

The pallet-mounted container 1 shown in FIG. 1 comprises a plastic container 1*a*, inserted in a sheet-metal shell made up of a sheet-metal jacket 2 in close contact with the plastic container and comprising a welded-on lid 3 and bottom 4, and a customary flat pallet 5 to which the shell is attached with the aid of claw plates 6. The plastic container 1*a* is provided in the center of its topside with a filling opening sealable by means of a screw cap 7 and has a discharge opening, sealable with a screw cap 8, at the bottom. The lid 3 and the sheet-metal jacket 2 have corresponding cutouts in the zones of the filling opening and the discharge opening. Water drain holes 9 are disposed at the four rounded corners of the lid 3.

To produce the sheet-metal jacket 2, a rectangular, cut-to-size-metal blank, not shown, made of galvanized steel sheet, is bent into a sheet-metal tube 10 and welded longitudinally; this can be done on a body-welding machine.

The sheet-metal tube 10 is placed on a rack press 11 (FIG. 2), the expansion jaws 12 of which correspond exactly to the shape of the plastic container in the zone of its narrow sides. After the sheet-metal tube 10 has been placed on the press, the expansion jaws 12 of the rack press 11 are moved apart with the aid of a hydraulic pressure-medium cylinder 14 (FIG. 3). During this step, the sheet-metal tube 10 assumes the configuration of the sheet-metal tube 10 assumes the configuration of the sheet-metal jacket 2. The sheet-metal tube 10 is applied to the rack press 11 in such a way that the longitudinal weld seam 15 of the sheet-metal tube 10 is along one of the narrow sides 13 of the sheet-metal jacket 2.

During the moving apart of the expansion jaws 12, the sheet-metal tube 10, or the thus-formed sheet-metal jacket 2, has the effect of a brake band, so that primarily the major sides 16 are stretched, since the expansion jaws 12 are urged apart to such an extent that the sheet-metal material is made to flow slightly in the major sides 16, and a slight "saber" effect is even produced in these sides 16. By the stretching of the material, the latter is not only stress-hardened, but there is also the additional effect that the sheet-metal jacket 2 assumes a final shape permitting it to closely contact the plastic container in the assembled condition and furthermore the sheet-metal jacket is thereby rendered maximally rugged with a minimum thickness of the sheet metal. Also, due to the stretching of the sheet-metal jacket 2, material can be saved during the cutting of the rectangular starting blank, and it is unnecessary to provide a complicated and expensive special press with large press dies for shaping the sheet-metal jacket 2.

Due to the fact that the longitudinal weld seam 15 lies on a narrow side 13 of the sheet-metal jacket 2, i.e. in a zone which is hardly stretched, or even not at all, the weld seam 15 is hardly exposed to any tensile or shearing forces, since the friction coefficient present at the rounded lateral edges 17 of the expansion jaws 12 prevents such forces.

Peepholes 19 are punched thereafter into one of the rounded vertical edges 18 of the sheet-metal jacket 2, so that the level of liquid in the plastic container can be seen and thus controlled at any time, since the plastic container is manufactured of a translucent, high-molecular-weight low-pressure polyethylene by the extrusion blow molding method. It has been found that these peepholes 19 do not weaken the sheet-metal shell of the pallet-mounted container 1. The cutting out of the cutout 20 for the discharge opening (screw cap 8) is likewise carried out after the stretching of the sheet-metal jacket 2. The lid 3 and the bottom 4 can be joined to the sheet-metal jacket 2 by roll or spot welding.

In view of the foregoing disclosure, therefore, it will be evident that the initially recited object of the present invention has been achieved.

Although the present invention has been described and illustrated in connection with a preferred embodiment, it is to be understood that modifications and variations may be resorted to without departing from the spirit of the invention, as those skilled in this art will readily understand. Such modifications and variations are considered to be within the purview and scope of the present invention as defined by the appended claims.

I claim:

1. A method for manufacturing a pallet-mounted container for liquids, of the type that comprises a synthetic resin liner container within a sheet-metal jacket secured to a supporting pallet, comprising bending a rectangular blank of steel sheet to the shape of a tube, longitudinally butt-welding the tube, placing the welded tube over a fluid pressure press having two jaws adapted to move apart under fluid pressure, moving said two jaws apart under fluid pressure thereby to produce a jacket having two relatively short sides in contact with said jaws and two relatively long sides between said jaws, continuing the movement of said jaws apart until said relatively long sides are stretched beyond their elastic limit, closing the top and bottom of said jacket with said liner container inside, and securing said jacket to said pallet.

2. A method as claimed in claim 1, in which said weld is against one of said jaws during the stretching of said long sides beyond their elastic limit.

* * * * *